US005224444A.

United States Patent [19]

Hill et al.

[11] Patent Number: 5,224,444

[45] Date of Patent: Jul. 6, 1993

[54] WALKING AIDS FOR ANIMALS

[76] Inventors: Richard W. Hill; Robert D. Hill, both of 1 Portland Drive, Forsbrook, Stoke-on-Trent, ST11 9AU, United Kingdom

[21] Appl. No.: 919,947

[22] Filed: Jul. 27, 1992

[30] Foreign Application Priority Data

Jul. 30, 1991 [GB] United Kingdom ..... 9116481

[51] Int. Cl.[5] ..... A61D 3/00

[52] U.S. Cl. ..... 119/102

[58] Field of Search ..... 119/101, 102, 29, 96; 280/47.38, 65

[56] References Cited

U.S. PATENT DOCUMENTS

| | | | |
|---|---|---|---|
| 380,744 | 4/1888 | Brigham | 280/65 |
| 394,141 | 12/1888 | Sproul | 280/75 |
| 2,419,656 | 4/1947 | Ressinger | 280/47.22 |
| 2,485,085 | 10/1949 | Burch | 280/65 |
| 2,546,726 | 3/1951 | Creamer, Jr. | 119/102 |
| 3,215,117 | 11/1965 | Short | 119/102 |
| 4,392,663 | 7/1983 | Forslund | 280/75 X |
| 4,676,807 | 7/1987 | Raybon | 280/65 |

*Primary Examiner*—Gene Mancene
*Assistant Examiner*—Thomas Price
*Attorney, Agent, or Firm*—Dellett, Smith-Hill and Bedell

[57] ABSTRACT

A walking aid for a four legged animal. The walking aid comprises a cradle attachable below the animal's hind quarters, and a support member pivotally attached to the cradle. A wheel arrangement is provided on the support member at its end remote from the cradle. Resiliency is provided for biassing the support member below the cradle.

8 Claims, 3 Drawing Sheets

WALKING AIDS FOR ANIMALS

The present invention concerns improvements in or relating to walking aids for animals, particularly but not exclusively walking aids for disabled dogs.

Many dogs suffer illneses or injuries which detrimentally affect the use of their rear legs, the dogs being in otherwise good condition and having a high life expectancy.

As a result of the consequent lack of mobility the dog looses a considerable amount of independence and thereby the burden imposed upon the dog's owner is considerably increased, in certain instances to such an extent that the dog is destroyed.

It has been proposed in the past to provide such disabled dogs with walking aids which generally comprise a wheeled arrangement on which the disabled hind quarters of the dog is placed so that the dog can walk un-aided. Such past devices have proved to be complicated and expensive but, more importantly, still demanded a considerable degree of attention from the dog's owner as the walking aid must be removed when the dog wishes to sit or lie.

It is an object of the present invention to obviate or mitigate these and other disadvantages.

According to the present invention there is provided a walking aid for a four legged animal comprising a cradle attachable below the animal's hind quarters, a support member pivotally attached to the cradle, a wheel arrangement on the support member at its end remote from the cradle and resilient means for biassing the support member below the cradle.

Preferably a body frame for attachment beneath the forequarters of the animal is pivotally attached to the end of the cradle remote from the attachment of the support member.

Preferably a linkage extends between the body frame and the support member on each side thereof and comprises a pair of articulated links, one of which is pivotal about the pivot axis between the cradle and the body frame, the other of which is pivotally mounted to the support member intermediate its ends.

Preferably means are provided on the body frame for attachment of harness means by which the body frame can be firmly attached to the animal.

Preferably at its end remote from its pivotal attachement to the cradle the body frame has downwardly extending legs.

Preferably the resilient means for the support member comprises a helical coiled spring attached between the support member and said linkage. Said linkage incorporates a first stop member to limit the pivotal movement of the support member in the direction of the spring bias applied thereto.

Preferably means are provided to lock the cradle against pivotal movement relative to the body frame.

Preferably a second stop member is provided to limit the extent of pivotal movement of the support member away from the cradle member against the spring bias. Said member may be attached to the linkage and, on abutment with the cradle, limits pivotal movement.

An embodiment of the present invention will now be described by way of example with reference to the accompanying drawings in which.

A walking aid for a disabled dog, that is a dog having little or no use of its hind legs, incorporates an open topped cradle 10 which, for comfort, is provided with a foam inlay 12 and is adapted to be located, in use, beneath the dog's hind quarters.

Figure 3:
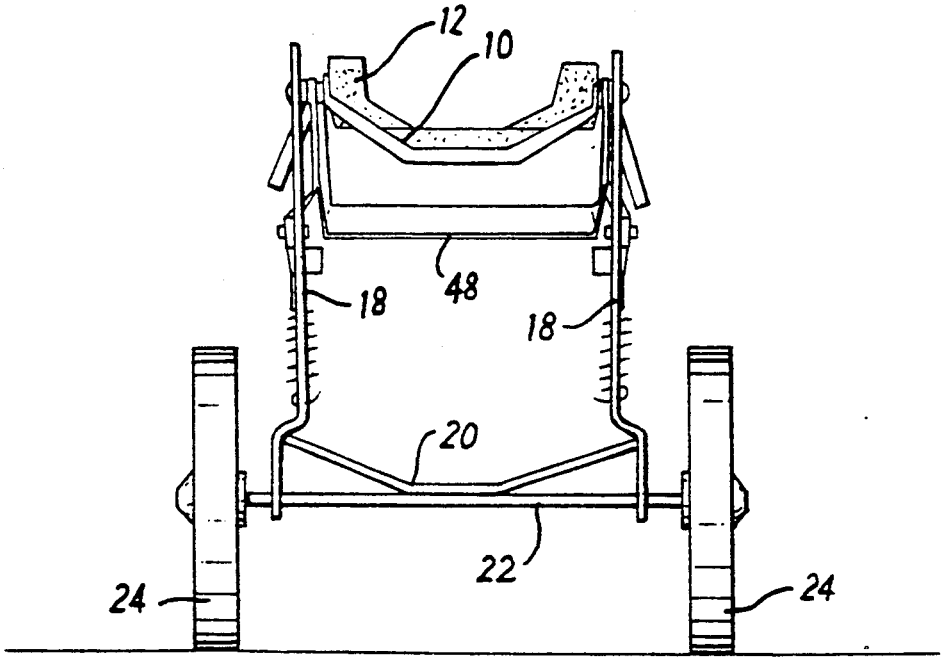
FIG. 3 shows a rear elevation of the walking aid in the upright position.

The cradle has a pair of longitudinally extending side members 14 attached to each of its sides by rivets 16 or by any other suitable means and at the rear end of each side member 14 there is pivotally attached a leg 18 of a support member which, as can be observed from FIG. 3 comprises a pair of spaced legs 18 (each being attached to a side member 14) which are connected adjacent their base by a strut 20 and support an axle 22 which carries freely rotatable wheels 24.

At the end of each side member 14 remote from the legs 18 there is pivotally mounted a body frame 26 which also comprises a pair of spaced members 28 each provided with a pair of lugs 30,32 to which fixing straps S (conveniently five in number) are connected by which the body frame can be firmly but comfortably attached to the forequarters of the dog along the dog's flanks by, for example, a pair of saddle straps extending over the dog's back, a single belly strap extending under the dog's belly and a breast and a retaining strap extending around the dog's breast and over its neck. At the leading end of each member 28 there is provided a downwardly extending leg 34, the length of which is less than the length of the legs 18 of the rear support member.

The point of pivotal attachment of the members 28 to the members 14 is spaced from the end of the members 28 such that when the members are in a substantially aligned condition a portion of each member 28 overlaps the corresponding portion of each member 14 and a locking ring 36, which is slidable along the members 14, can hold the members 14 and 28 against pivotal movement when it is slid into a position where it embraces both members 14 and 28.

Figure 1:
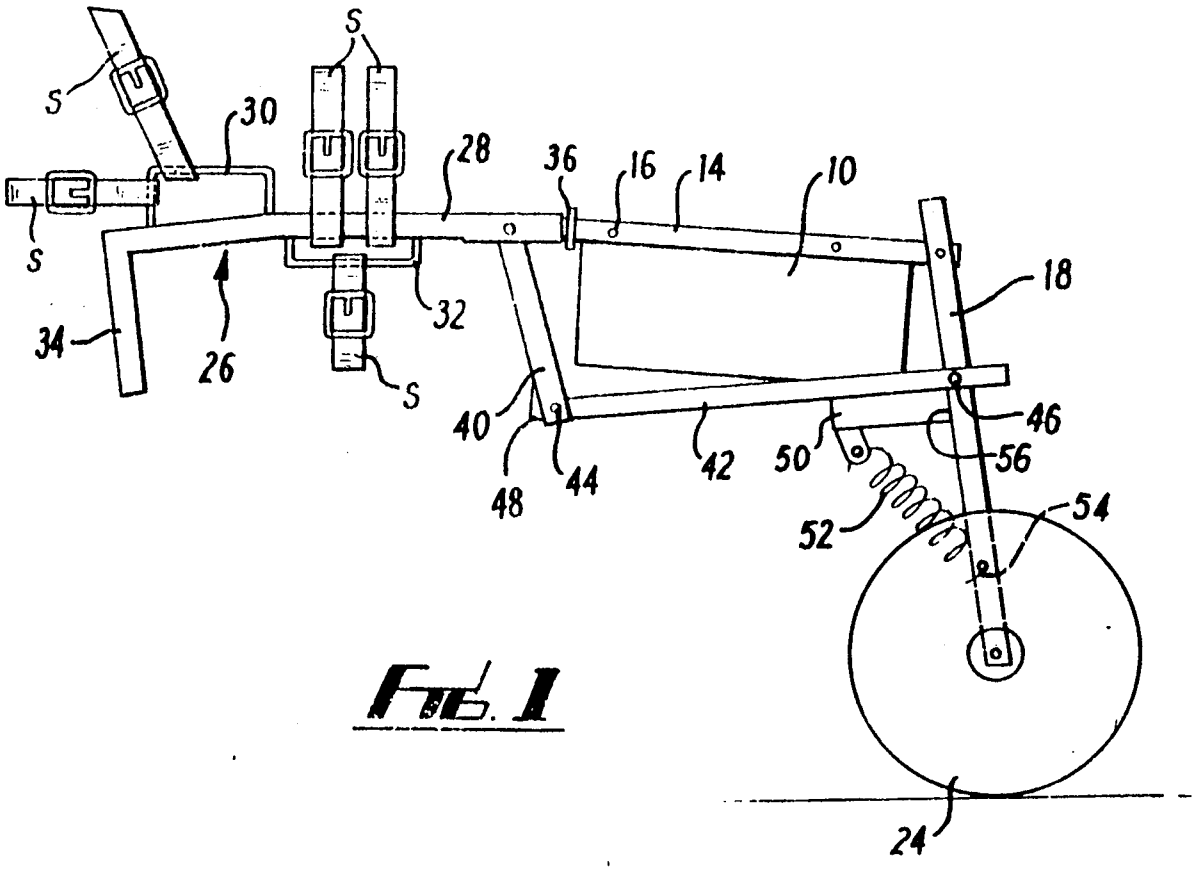
FIG. 1 shows a side elevation of a walking aid for a disabled dog in the erect or walking position.
Figure 2:
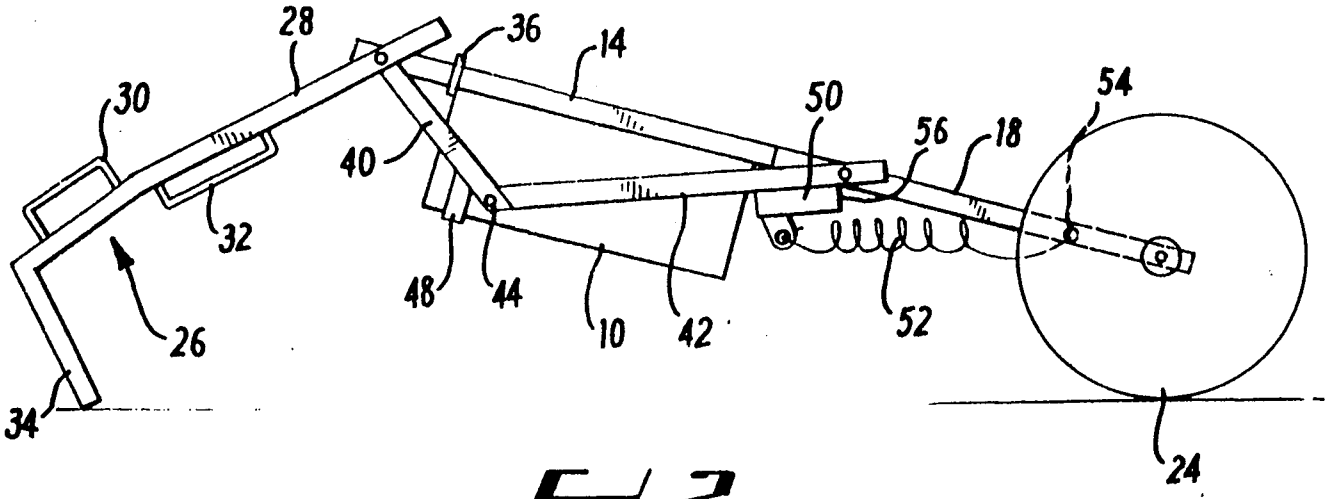
FIG. 2 shows an elevation of the aid in the collapsed or lying position.

The locking ring 36 must be in the free position illustrated in FIG. 1 to allow the aid to collapse into the condition shown in FIG. 2 of the drawing. In the position shown in FIG. 1 the dog is in a walking position and on the assumption that the support frame 18 is held against pivotal movement relative to the cradle the dog can walk with its rear end supported on the wheels. If the dog wishes to lie down then the aid must assume the condition shown in FIG. 2 where the legs 18 extend rearwardly of the cradle.

One of the main features of the present invention is that the dog itself can determine whether the aid has to assume the walking or collapsed condition simply by a change in weight distribution and this feature of the aid is achieved by spring biassing the legs 18 relative to the cradle by the aid of an articulated linkage.

A similar linkage is provided on each side of the aid and only one will now be described. The linkage comprises two links 40 and 42 pivotally joined by a pivot 44 at their ends. The shorter link 40 is fixed against rotation relative to member 28 and is pivotally attached to member 14 about the axis around which these members pivot. The longer link 42 is pivotally attached about a pivot point 46 to a leg 18 intermediate the ends of the leg.

Extending between the members 40 there is provided a yoke member 48 which holds the pairs of links against lateral separation and provides a further function to be described later. Towards the pivot 46 the leg 42 has a stop member 50 fixed thereto to which a helical coiled compression spring 52 is fixed, its other end 54 being fixed to the leg close to the bottom of the leg.

Consideration of the drawings will show that the spring will cause the leg 18 to tend to move in the clockwise direction, as viewed in the drawing, but this movement is resisted by abutment of the leg 18 against the end face 56 of the stop 50 which is positioned in the path of the leg. It will be appreciated that, apart from the restrain exterted by the spring 52, there is no resistance to the anti-clockwise movement of the leg 18 such that the dog, by transferring weight to the cradle can cause the leg 18 to pivot anti-clockwise against the action of the spring into the position shown in FIG. 2 at which the dog is in a lying position. So that in this position the dog does not necessarily support the entire weight of the aid the length of the front leg 34 is so chosen that they comes into ground contact.

So that the leg 18 does not pivot anti-clockwise beyond the predetermined position the yoke 48 fixed to the first links 40 is adapted to abut the underside of the cradle 10 and prevent further movement at the point just before the longitudinal axis of the leg 18 becomes aligned with that of the side member 14.

Various modifications can be made without departing from the scope of the invention. For example the position, dimension and shape of the various members can be altered to take account of animals of differing sizes, shapes and characteristics. The linkage arrangement between the body member and the rear legs can take any convenient form and the coiled springs 52 could be replaced by any other suitable resilient means, for example, hydraulic or pneumatic means. The wheels 24 may be of a different type from those described.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A walking aid for a four legged animal comprising a cradle attachable below the animal's hind quarters, a support member pivotally attached to the cradle at an attachment position, a wheel arrangement on the support member at a location remote from the cradle and resilient means for biassing the support member below the cradle, wherein a body frame for attachment beneath the forequarters of the animal is attached to the cradle for pivotal movement about a pivot axis remote from said attachment position, and wherein a linkage extends between the body frame and the support member and comprises a pair of articulated links, one of which is pivotal about said pivot axis, the other of which is pivotally mounted to the support member intermediate its ends.

2. A walking aid according to claim 1, wherein the resilient means for the support member comprises a helical coiled spring attached between the support member and said linkage, said linkage incorporating a first stop member to limit the pivotal movement of the support member in the direction of the by the spring bias applied thereto.

3. A walking aid according to claim 2, wherein a second stop member is provided to limit pivotal movement of the support member away from the cradle against the bias applied by the spring.

4. A walking aid according to claim 3, wherein said second stop member is attached to said linkage and, on abutment with said cradle, limits pivotal movement of said support member relative to said cradle.

5. A walking aid according to claim 1, wherein means are provided on the body frame for attachment of a harness means adapted to engage the animal by which the body frame can be firmly attached to the animal.

6. A walking aid according to claim 1, wherein at its end remote from its pivotal attachment to the cradle the body frame has downwardly extending legs.

7. A walking aid according to claim 1, wherein means are provided to lock the cradle against pivotal movement relative to the body frame.

8. A walking aid for a four legged animal comprising:

a cradle having a forward end and a rearward end and attachable below the animal's hind quarters;

a support member having an upper end and a lower end, said support member pivotally attached near the upper end thereof to said cradle near the rearward end thereof;

a wheel arrangement on the support member near the lower end thereof;

resilient means for biassing the support member below the cradle;

a body frame for attachment beneath the forequarters of the animal, pivotally attached to the cradle at a pivot axis near the forward end of the cradle, for pivotal movement about said pivot axis; and a linkage extending between the body frame and the support member, comprising a pair of articulated links, one of which is pivotable about said pivot axis, the other of which is pivotally mounted to the support member intermediate its upper and lower ends.

* * * * *